US006729323B1

(12) United States Patent
Little et al.

(10) Patent No.: US 6,729,323 B1
(45) Date of Patent: May 4, 2004

(54) AIR-INLET ASSEMBLY FOR A GAS COOKING APPLIANCE

(75) Inventors: Derrick Douglas Little, Louisville, KY (US); Erick Paul Graven, Louisville, KY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/248,973

(22) Filed: Mar. 6, 2003

(51) Int. Cl.[7] ..... F24C 3/00
(52) U.S. Cl. ..... 126/39 R; 126/15 R; 126/214 R
(58) Field of Search ..... 126/211, 214 R, 126/216, 214 A, 193, 15 R, 39 R

(56) References Cited

U.S. PATENT DOCUMENTS 3,645,249 A 2/1972 Henderson et al.
3,734,681 A 5/1973 Perl
5,653,219 A 8/1997 Taplan et al.
6,067,980 A 5/2000 Kahlke et al.

*Primary Examiner*—Jiping Lu
(74) *Attorney, Agent, or Firm*—H. Neil Houser; Armstrong Teasdale LLP

(57) ABSTRACT

A method for guiding air into a cooktop to supply air to at least one gas cooking element to produce a flame is provided. The cooktop includes a front edge, a rear edge and two side edges extending therebetween. The cooktop has a gap along at least one of the front edge, the rear edge, and the two side edges. The method includes providing a louver and attaching the louver to at least one of the front edge, the rear edge, and the two side edge for guiding air into the gap of at least one of the front edge, the rear edge, and the two side edges.

21 Claims, 3 Drawing Sheets

AIR-INLET ASSEMBLY FOR A GAS COOKING APPLIANCE

BACKGROUND OF INVENTION

This invention relates generally to gas cooking appliances, and, more particularly, to an air-inlet assembly for a cooking appliance.

Gas fired stoves, ovens, and ranges typically include one or more gas heating elements coupled to a main gas line to the appliance and providing fuel to the heating elements, sometimes referred to as burners. In a domestic range, a gas line is connected to a distribution manifold within the appliance to direct gas to a plurality of surface burner elements on a cooktop or to baking elements within an oven cavity. Operation of the burners and cooking elements is usually accomplished with burner control knobs mounted on the front wall of the appliance in front of the cooktop. Below each knob is a circular orifice, which allows air to pass down into the burner box of the cooktop. When a control knob is actuated, fuel is supplied to associated heating elements and an ignition module creates a spark to ignite the gas and produce a flame.

Electronic, touch sensitive, glass control interfaces are becoming increasingly popular in modern range ovens to control a variety of cooking elements, including but not limited to a bake element and a broil element in a cabinet cooking cavity. Known electronic controls have facilitated oven features and modes of baking operation not found in conventional mechanically controlled ranges. By implementing a glass touch control on a gas cooktop, the primary source of air for the burner box no longer exists.

SUMMARY OF INVENTION

In one aspect, a method for guiding air into a cooktop to supply air to at least one gas cooking element to produce a flame is provided. The cooktop includes a front edge, a rear edge and two side edges extending therebetween. The cooktop has a gap along at least one of the front edge, the rear edge, and the two side edges. The method includes providing a louver and attaching the louver to at least one of the front edge, the rear edge, and the two side edge for guiding air into the gap of at least one of the front edge, the rear edge, and the two side edges.

In another aspect, an air input system for a gas cooktop of a cooking apparatus is provided. The gas cooktop includes at least one gas cooking element, a front edge, a rear edge, and two side edges extending therebetween. At least one of the front edge, rear edge, and the two side edges form a gap so as to provide air to the at least one gas cooking element. The air input system includes an airfoil portion having a top surface and a bottom surface extending between a first end and a second end. The airfoil portion guides air into the gap. The air input system further includes an attachment portion having a lip extending from the bottom surface so as to form a groove between the airfoil and the lip. The groove is sized to receive at least one of the front edge, the rear edge and the two side edges.

In a further aspect, a gas cooking apparatus is provided. The gas cooking apparatus includes a gas cooktop having a front edge, a rear edge, and two side edges extending therebetween, at least one gas cooking element, a gas line supplying gas to the at least one gas cooking element and a louver coupled to at least one of the front edge, rear edge, and the two side edges. The louver includes includes an airfoil portion having a top surface and a bottom surface extending between a first end and a second end. The airfoil portion configured to guide air into the gap. The air input system further includes an attachment portion having a lip extending from the bottom surface so as to form a groove between the airfoil and the lip. The groove is sized to receive at least one of the front edge, the rear edge and the two side edges.

DETAILED DESCRIPTION

The term cooktop as used herein refers to a cooking system that includes at least one gas heating element or burner. A cooktop system can be a stand-alone unit that is mounted, for example, on a kitchen countertop. A cooktop system also can be integrated with an oven to form a range. Ranges including cooktop systems and stand alone cooktop systems are commercially available from the GE Appliances business, Louisville, Kentucky, of General Electric Company.

Cooktop systems typically have a generally planar glass-ceramic or porcelain cooking surface with heating units located just below the cooking surface. Each heating unit, or heater, is operable at various power levels. Prior to operation, a user typically positions a pot or pan containing food on the glass cooking surface over a heater to be operated and selects, via a user interface, a desired power level for the heating element. The cooktop system responds by supplying power (i.e. Gas) to the selected heating element in accordance with the user selected power level.

Figure 1:
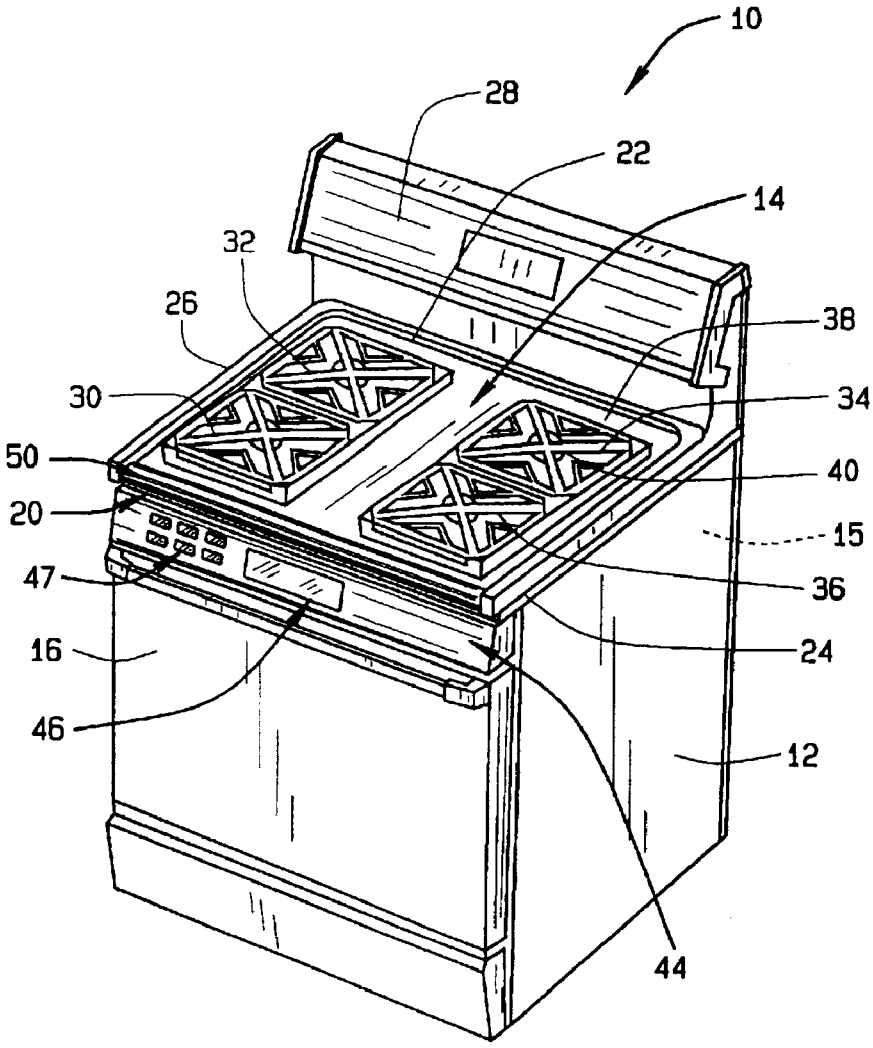
FIG. 1 illustrates an exemplary free standing gas range.
Figure 2:
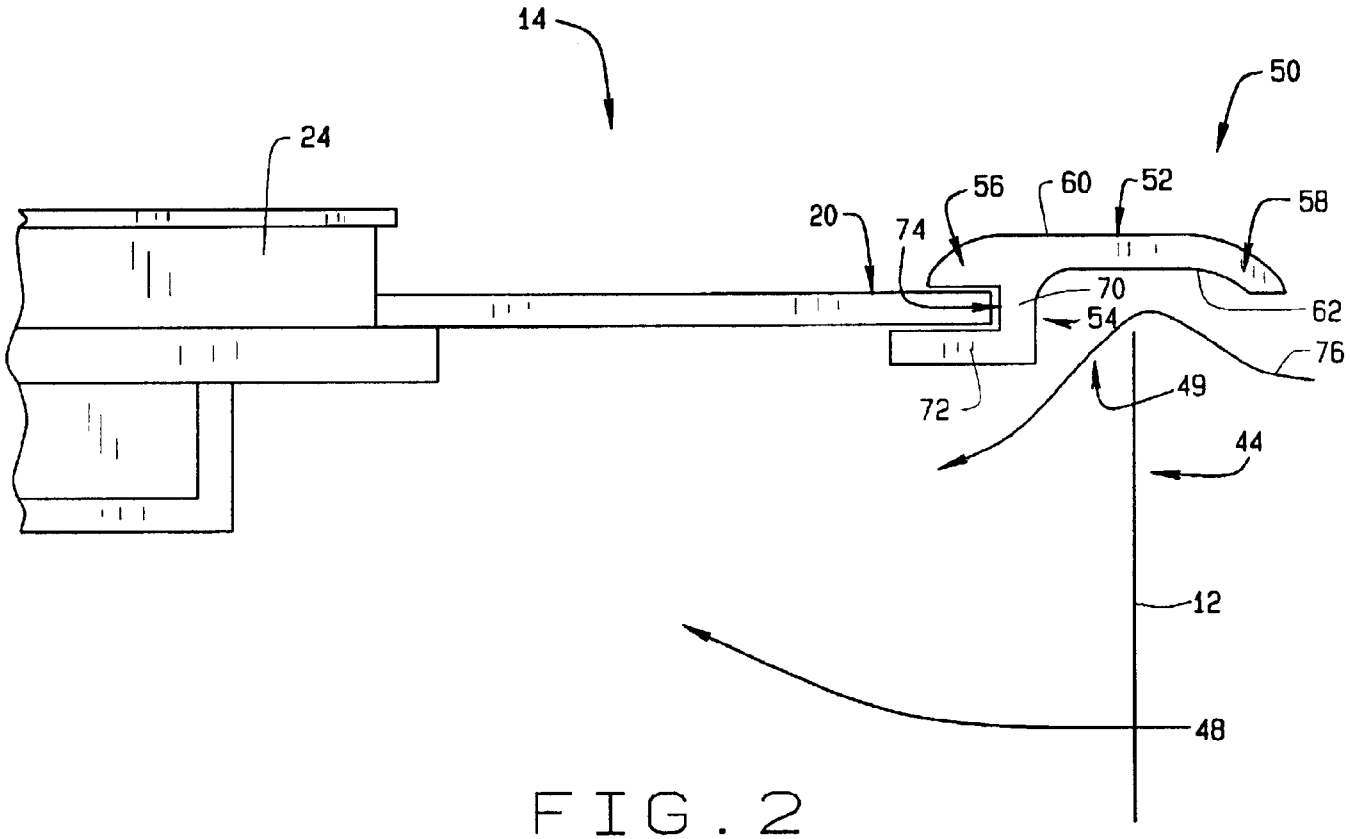
FIG. 2 is a side view of a louver attached to the gas range shown in FIG. 1.

FIG. 1 illustrates a gas cooking appliance in the form of a free standing gas range 10 including an outer body or cabinet 12 that incorporates a generally rectangular cooktop 14. FIG. 2 is a side view of cooktop 14. An oven 15 is positioned below cooktop 14 and has a front-opening access door 16. Cooktop 14 has a front edge 20, a rear edge 22 and side edges 24 and 26 extending between front edge 20 and rear edge 22. A range backsplash 28 extends upward of rear edge 22 of cooktop 14 and contains various control selectors (not shown) for selecting operative features of heating elements for cooktop 14 and the oven. It is contemplated that the benefits of the present invention are applicable, not only to cooktops which form the upper portion of a range, such as range 10, but to other forms of cooktops as well, such as, but not limited to, countertops that are mounted to kitchen counters. Therefore, gas range 10 is provided by way of illustration rather than limitation, and accordingly there is no intention to limit application of the present invention to any particular appliance or cooktop, such as range 10 or cooktop 14. In addition, it is contemplated that the benefits of the present invention are applicable to dual fuel cooking appliances, e.g., a gas cooktop with an electric oven.

Cooktop 14 includes four gas fueled cooking elements or burners 30, 32, 34 and 36 which are positioned in spaced apart pairs 30, 32 and 34, 36 positioned adjacent each side of cooktop 14. Each pair of burners 30, 32, 34 and 36 is surrounded by a recessed area (not shown in FIG. 1) respectively, of cooktop 14. The recessed areas are positioned below an upper surface 38 of cooktop 14 and serve to catch any spills from cooking utensils being used with cooktop 14. Each burner 30, 32, 34 and 36 extends upwardly through an opening in cooktop 14, and a grate assembly 40 is positioned over each respective pair of burners 30, 32, 34 and 36. Typically, each of the burners 30, 32, 34 and 36 of cooktop 14 are connected by a gas line (not shown) to a manifold (not shown). The construction and operation of the range heating elements, including cooktop gas burners are believed to be within the purview of those in the art without further discussion.

In one embodiment, an input interface panel 44 includes a display 46 and a plurality of input selectors 47 in the form of touch sensitive buttons or keypads for accessing and selecting oven features. In alternative embodiments, other known input selectors are used in lieu of touch sensitive switches.

Unlike burner control knob type ovens, input interface panel 44 does not have orifices to allow air to enter a burner box 48 underneath cooktop 14. Therefore, front edge 20 of cooktop 14 is shortened with respect to cabinet 12 defining a gap 49 between front edge 20 and cabinet 12. Gap 49 permits air to enter burner box 48 so as to mix with the gas to ignite and produce a flame.

In the exemplary of FIG. 2, a louver 50 is fitted on front edge 20 of cooktop 14. Louver 50 guides air through gap 49 to provide air to the burner box 48 of cooktop In one embodiment, at least one of side edges 24 and 26 is shortened with respect to cabinet 12 and louver 50 is mounted on at least one of side edges 24 and 26. In another embodiment, rear edge 22 is shortened with respect to cabinet 12 and louver 50 is mounted on rear edge 22. In another embodiment, louver 50 is made of stainless steel. In another embodiment, louver 50 is made of plastic. In one embodiment, louver 50 is secured to at least one of front edge 20, rear edge 22, and side edges 24 and 26 by an adhesive or a fastener.

Louver 50 has an airfoil portion 52 and an attachment portion 54. Airfoil portion 52 has a first end 56, a second end 58, a top surface 60, and a bottom surface 62. Top and bottom surfaces 60 and 62 extend between first and second end 56 and 58. In one embodiment, at least one of top and bottom surface 60 and 62 is curved.

Attachment portion 54 has a support member 70 extending from bottom surface 62 of airfoil portion 52. In one embodiment, support member 70 extends substantially perpendicular from bottom surface 62. Attachment portion 54 has a lip 72 extending substantially perpendicular to support member 70 so as to form a groove 74 between lip 72 and first end 56 of airfoil portion 52. As shown in FIG. 2, bottom surface 62 guides air, indicated by arrow 76, into and through gap 49 providing air to burner box 48. In one embodiment, louver 50 is a vent allowing excess heat to exhaust from burner box 48.

Figure 3:
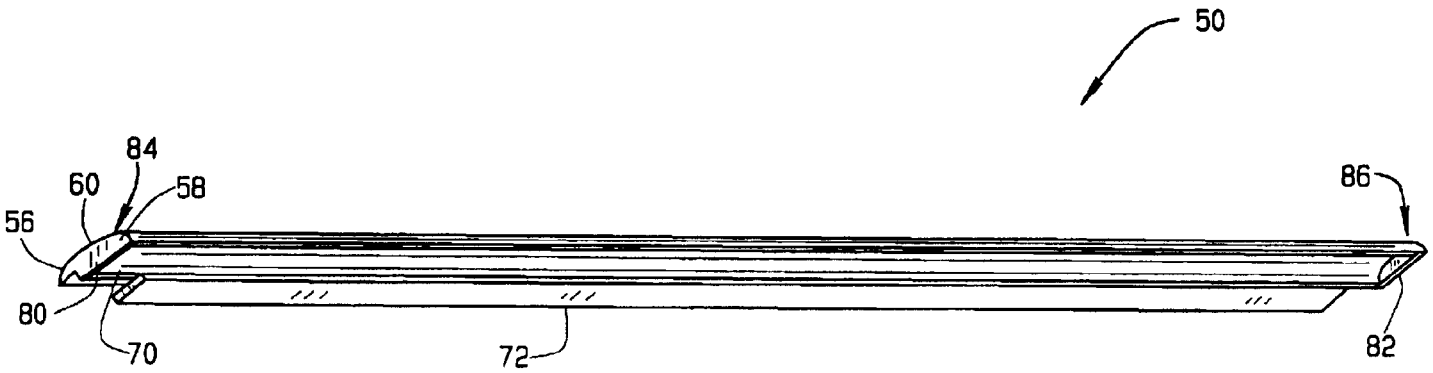
FIG. 3 is a bottom perspective view of the louver.

FIG. 3 is a bottom perspective view of louver 50. In the exemplary embodiment, louver 50 is elongate with side walls 80 and 82 at opposing ends 84 and 86. Sidewalls 80 and 82 prevent food and liquid from entering the burner box of cooktop 14. Lip 72 extends substantially along the length of louver 50. In one embodiment, louver 50 has at least one section along the length of louver 50 without airfoil portion 52 to accommodate various cooktop designs or structures, such as grate assembly 40. In another embodiment, louver 50 has at least one section along the length of louver 50 without attachment portion 54 to accommodate various cooktop designs or structures. In a further embodiment, first end 56 of airfoil portion 52 has at least one cutout section to accommodate various cooktop designs or structures.

The above described louver directs air to the burner box thereby supplying sufficient air to ignite and produce a flame. In addition, the louver prevents food or liquid from entering the burner box. As a result, the louver improves the performance of a gas unit and improves the cleanability of the cooktop in a cost effective and time-saving manner.

While the invention has been described in terms of various specific embodiments, those skilled in the art will recognize that the invention can be practiced with modification within the spirit and scope of the claims.

What is claimed is:

1. A method for guiding air into a cooktop to supply air to at least one gas cooking element to produce a flame, the cooktop including a front edge, a rear edge and two side edges extending therebetween, the cooktop having a gap along at least one of the front edge, the rear edge, and the two side edges, said method comprising:

providing a louver; and attaching the louver to at least one of the front edge, the rear edge, and the two side edges for guiding air into the gap of at least one of the front edge, the rear edge, and the two side edges.

2. A method in accordance with claim 1 wherein providing a louver further comprises providing a louver having an attachment portion for attaching to at least one of the front edge, the rear edge, and the two side edges and an airfoil portion for guiding the air in the gap.

3. A method in accordance with claim 2 wherein providing a louver having an airfoil portion and an attachment portion further comprises providing the attachment portion with a lip extending from the attachment portion so as to form a groove between the lip and the airfoil portion, the groove is sized to receive at least one of the front edge, the rear edge, and the two side edges.

4. A method in accordance with claim 1 further comprises securing the louver to at least one of the front edge, the rear edge, and the side edges.

5. A method in accordance with claim 4 wherein securing the louver further comprises securing the louver using an adhesive.

6. A method in accordance with claim 4 wherein securing the louver further comprises securing the louver using a fastener.

7. A method in accordance with claim 3 wherein providing a louver having an airfoil portion and an attachment portion further comprises providing that the airfoil portion is curved to direct air into the gap of at least one of the front edge, the rear edge and the two side edges.

8. An air input system for a gas cooktop of a cooking apparatus, the gas cooktop including at least one gas cooking element, a front edge, a rear edge, and two side edges extending therebetween, at least one of said front edge, rear edge, and the two side edges forming a gap so as to provide air to said at least one gas cooking element, said air input system comprising:

an airfoil portion having a top surface and a bottom surface extending between a first end and a second end, said airfoil for guiding air into said gap; and an attachment portion having a lip extending from said bottom surface so as to form a groove between said airfoil and said lip, said groove sized to receive at least one of said front edge, said rear edge and said two side edges.

9. An air input system of claim 8 wherein said attachment portion further comprises a support member extending substantially perpendicular from said bottom surface, said lip extending substantially perpendicular from said support member so as to form said groove between said lip and said first end of said airfoil portion.

10. An air input system of claim 8 wherein said airfoil portion further comprises:

a plurality of opposing ends; and a sidewall at each said opposing end.

11. An air input system of claim 10 wherein said air input system is substantially elongate between opposing ends.

12. An air input system of claim 8 wherein said lip extends substantially along the length of said bottom surface of said airfoil portion.

13. An air input system of claim 8 wherein said at least one of said top and bottom surface is curved.

14. An air input system of claim 8 wherein said bottom surface directs air into said gap.

15. An air input system of claim 8 wherein said first end of said airfoil portion has at least one cutout section.

16. A gas cooking apparatus comprising:

a gas cooktop having a front edge, a rear edge, and two side edges extending therebetween;

at least one gas cooking element;

a gas line supplying gas to said at least one gas cooking element;

a louver coupled to at least one of said front edge, said rear edge, and said two side edges, said louver comprising:

an airfoil portion having a top surface and a bottom surface extending between a first end and a second end, said airfoil configured to guide air into said gap; and an attachment portion having a lip extending from said bottom surface so as to form a groove between said airfoil and said lip, said groove sized to receive at least one of said front edge, said rear edge and said two side edges.

17. An air input system of claim 16 wherein said attachment portion further comprises a support member extending substantially perpendicular from said bottom surface, said lip extending substantially perpendicular from said support member so as to form said groove between said lip and said first end of said airfoil portion.

18. An air input system of claim 16 wherein said airfoil portion has sidewalls at opposing ends.

19. An air input system of claim 18 said airfoil portion further comprises:

a plurality of opposing ends; and a sidewall at each said opposing end.

20. An air input system of claim 16 wherein said lip extends substantially along the length of said bottom surface of said airfoil portion.

21. An air input system of claim 16 wherein bottom surface is curved and directs air into said gap.

* * * * *